United States Patent [19]

Sato et al.

[11] 4,298,268

[45] Nov. 3, 1981

[54] METHOD AND DEVICE FOR CLEANING PHOTOSENSITIVE SCREEN IN AN IMAGE FORMING APPARATUS

[76] Inventors: Tadashi Sato, 24-20, Nishimachi 4-chome, Kokubunji-shi, Tokyo; Keiji Tanaka, 506, Kuji, Takatsu-ku, Kawasaki-shi, Kanagawa-ken, both of Japan

[21] Appl. No.: 947,198

[22] Filed: Sep. 29, 1978

Related U.S. Application Data

[63] Continuation of Ser. No. 549,437, Feb. 12, 1975, abandoned.

[30] Foreign Application Priority Data

Feb. 25, 1974 [JP] Japan ..... 49-22149
Jul. 27, 1974 [JP] Japan ..... 49-86379

[51] Int. Cl.[3] ..... G03G 15/00

[52] U.S. Cl. ..... 355/3 SC; 355/15; 355/77; 430/53

[58] Field of Search ..... 355/3 SC, 15, 3 R, 3 DR, 355/77; 96/1 R, 1.4

[56] References Cited

U.S. PATENT DOCUMENTS

| | | | |
|---|---|---|---|
| 2,752,271 | 6/1956 | Walkup et al. | 355/15 X |
| 3,105,777 | 10/1963 | Bickmore et al. | 355/15 X |
| 3,680,954 | 8/1972 | Frank | 355/3 SC |
| 3,809,556 | 5/1974 | Pressman et al. | 355/3 R X |
| 3,957,365 | 5/1976 | Croft | 355/3 R |

*Primary Examiner*—Richard L. Moses

[57] ABSTRACT

A device for cleaning a photosensitive screen having a multitude of fine openings for use in image formation wherein primary and secondary electrostatic latent images are formed on the screen by voltage application, the device being constructed with means for rubbing the photosensitive screen, wall means for enclosing substantially the entire rubbing means, and means for drawing out of the wall means an atmosphere containing dust which has been removed from the rubbing means.

4 Claims, 13 Drawing Figures

METHOD AND DEVICE FOR CLEANING PHOTOSENSITIVE SCREEN IN AN IMAGE FORMING APPARATUS

This is a continuation, of application Ser. No. 549,437 filed Feb. 12, 1975, now abandoned.

BACKGROUND OF THE INVENTION

1. Field of the Invention

This invention relates to electrophotography, and, more particularly, it is concerned with a novel method and device for cleaning a photosensitive screen having a multitude of fine openings therein for use in forming an image by modulation of ion current.

2. Description of the Prior Arts

The conventional electrophotographic method is generally such that, after formation of an electrostatic latent image on a photosensitive body, the thus formed latent image is caused to closely contact other chargeable image recording material such as, for example, electrostatic recording paper, and so forth to transfer the latent image onto the recording material, and finally this recording material is developed to obtain a desired image.

In the above-described electrophotographic method, unlike a method, wherein a toner image on a photosensitive body is transferred onto a recording medium such as image transfer paper, etc., as there are carried out no development and cleaning in preparation for such development on the photosensitive body, the surface of the photosensitive body receives very little physical damage.

Other methods of forming an image without necessity for developing the photosensitive body are taught in U.S. Pat. Nos. 3,713,734, 3,680,954, and so forth.

In this new image forming method by electrophotography which is called "screen process", a photosensitive screen having a multitude of fine openings to serve as the photosensitive body (hereinafter referred to simply as "screen") is able to form an electrostatic latent image in the picture image form on a recording material by modulating ion currents from electric discharge rather than simultaneously contacting the recording material to the photosensitive body. That is, the screen is not subjected to any mechanical work such as close contact of the recording material thereto, the cleaning thereof to be carried out after development at every image forming operation, and so forth, hence the screen is durable for use over a long period of time. In case, however, the surface of the abovementioned screen is made of an insulative substance (inclusive of photoconductive substance) such as, for example, vitreous selenium, resin, etc., there inevitably occurs change on the surface state of the screen which has been exposed to a corona discharge for a long period of time with the result that it becomes impossible to maintain sufficiently good electric charge thereon. (This of course applies not only to the screen of the present invention, but also to the conventional photosensitive body for electrophotography).

As a result of research and investigation, the cause for this phenomenon has been found to be due to the fact that very small dust in the form of fine particles of from 0.1 to 50 microns in diameter and consisting of electrically conductive substances and oxides of silicon, which are floating in the air, are electrically charged by the corona discharge to adhere to the surface and the openings of the screen. By this adherence of the fine particles, the insulative portion on the surface of the screen reduces its image resistance with the consequence that the electrostatic contrast of the formed image becomes low, or, when the dust is of a large particle size, it clogs the openings of the screen to bring about undesirable phenomena for the image formation. Further continuation of such adherence of the dust and dust-like fine particles would make it impossible to form visible picture images suitable for practical use. Particularly, in the case of the screen as the photosensitive body, most of the screen is flexible or supple in view of the raw material used to produce the same, so that employment of the conventional cleaning device to such screen is problematical for the reasons to be mentioned hereinbelow. That is, contact of the cleaning device to the surface of the screen at fairly high pressure would disturb the electrostatic latent image formed on the screen, or the friction between the cleaning member and the screen surface would deform or damage the screen surface to bring about undesired effects such as a shortening of the life of the screen, and so on. Furthermore, the dust adhered onto the opening of the screen cannot be removed by the surface rubbing alone. Moreover, in the screen capable of making retention copies, such dust adherence inevitably decreases its capability for retention copying.

In the case of the photosensitive body for the xerographic reproduction system, there is carried out cleaning of the photosensitive body after transfer of the toner-developed image onto an image transfer material so as to remove excessive amount of the toner remaining on the photosensitive body. At this cleaning operation, the abovementioned dust which is detrimental to the image reproduction is also eliminated from the surface of the photosensitive body along with the toner, so that there takes place no problem due to accumulation of the dust on the photosensitive body.

SUMMARY OF THE INVENTION

It is therefore a primary object of the present invention to provide a method and apparatus for cleaning the photosensitive screen for use in electrophotographic apparatus so as to obtain constantly favorable picture images, while solving the aforementioned various problems inherent in conventional electrophotography.

It is another object of the present invention to provide a method and device for cleaning the photoconductive screen without deforming or damaging the screen surface, or without changing the forming conditions for the electrostatic latent image.

It is still another object of the present invention to provide a method and apparatus for constantly preventing dust and dust-like fine particles from adhering to the photosensitive screen.

According to the present invention, in one aspect thereof, there is provided a method and apparatus for cleaning the photosensitive screen in an image forming apparatus, the screen of which is provided with a multitude of tiny openings and operates to modulate ion current due to electric discharge to form the image, wherein a liquid is applied onto the screen, and such applied liquid is removed by a cleaning member, while the same liquid is being successively applied to the screen.

According to the present invention, in another aspect thereof, there is provided a method and apparatus for cleaning the photosensitive screen, wherein a highly pressurized fluid is caused to pass through the fine openings of the abovementioned photosensitive screen.

According to the present invention, in still another aspect thereof, there is provided a method and apparatus for cleaning the photosensitive screen, wherein a liquid is applied to the fine openings of the screen, then a highly pressurized fluid substance (including gas) is caused to pass through the openings, and the abovementioned applied liquid is removed from the screen by rubbing with a cleaning member.

The foregoing objects and other objects as well as the detailed construction and operations of the present invention will become more apparent from the following detailed description thereof, when read in conjunction with the accompanying drawing.

DESCRIPTION OF THE PREFERRED EMBODIMENTS

Throughout the specification, the term "primary electrostatic latent image" means by an electrostatic latent image formed from an original picture image on the photoconductive screen in accordance with a prescribed image forming process, and the term "secondary electrostatic latent image" means by an electrostatic latent image formed on a recording member capable of maintaining electric charge by modulating ion current by means of the abovementioned primary electrostatic latent image. Also, the term "retention copy" means image formation a plurality of times from a single primary electrostatic latent image.

In the following, the present invention will be explained in more detail and concreteness in reference to the accompanying drawings showing various actual embodiments of the device according to the present invention, i.e., the construction of the photosensitive screen used in the embodiments, will be explained in reference to FIG. 1, and the actual embodiment of electrostatic latent image forming process by means of the screen in FIG. 1 will be explained in reference to FIGS. 2 to 5. In this connection, it should be noted that the present invention is of course applicable to other photosensitive screens than that mentioned in the present application, hence the invention is not restricted only to the screen and the latent image forming process to be described hereinbelow.

Figure 1:
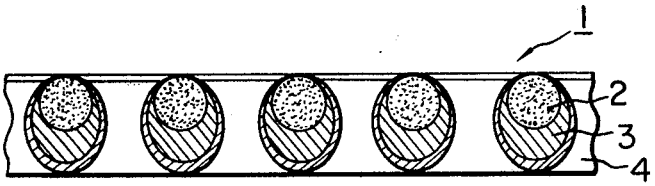
FIG. 1 is an enlarged cross-sectional view of one example of the photosensitive screen for use in explaining the present invention.

The photosensitive screen shown in FIG. 1 is so constructed that a photoconductive member 3 and an insulative member 4 are coated in laminar structure on an electrically conductive member 2 having a multitude of tiny openings. The coating is done in such a manner that the electrically conductive member 2 may be exposed in part.

The abovementioned conductive member 2 is manufactured by etching a metal plate such as stainless steel, nickel, and so on, to form therein a multitude of tiny openings, or by electroplating such conductive material on a wire net to serve as the screen, or by weaving wire of such conductive material in the form of a net. The mesh size of the conductive member 2 may range from 100 to 400 meshes (100 to 400 openings per linear inch) from the standpoint of resolution of the original image for reproduction.

The photoconductive member 3 is deposited on the conductive member 2 by means of evaporative deposition of selenium alloys, etc., or spray-coating of an insulative resin dispersion containing therein dispersed particles of cadmium sulfide (CdS), lead oxide (PbO), etc.

The abovementioned insulative member 4 can be formed by spray-coating or vacuum-evaporative deposition of a solvent type organic insulative material such as epoxy resin, acrylic resin, silicon resin, and so forth.

It should be added incidentally that the material and method of manufacturing the screen may be one used for the planar photosensitive body in the conventional electrophotographic techniques, and that, for the abovementioned members 3 and 4 to be coated on the conductive member 2 in such a manner that a part of the same is exposed outside, they may be coated from one side of the conductive member 2 with the other side left open to be exposed, or they may completely surround the conductive member 2, after which a part of each of these members 3 and 4 is removed by grinding.

The electrostatic latent image forming process using the abovementioned photosensitive screen shown in FIG. 1 will now be explained in reference to FIGS. 2 and 5. Throughout the explanations hereinbelow, the screen used has such characteristic that the positive hole is injected into the photoconductive member even at the dark place. In the drawing, the photoconductive member 3 is made of a semiconductor consisting of selenium and its alloys with the hole as the principal carrier.

Figure 2:
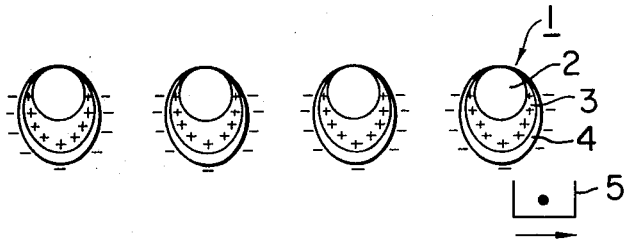
FIGS. 2 to 4 inclusive are respectively schematic diagrams showing one embodiment of the primary electrostatic latent image forming process by the photosensitive screen shown in FIG. 1 above.

FIG. 2 indicates the results after the primary voltage application has been carried out, wherein the insulative member 4 is uniformly charged to the negative polarity by an electric charging means such as a corona discharger, and so on. By this electric charging, the hole is injected into the interior of the photoconductive member 3 through the conductive member 2, and is captured at the interface in the vicinity of the insulative member 4. The reference numeral 5 in FIG. 2 designates the corona discharger.

Figure 3:
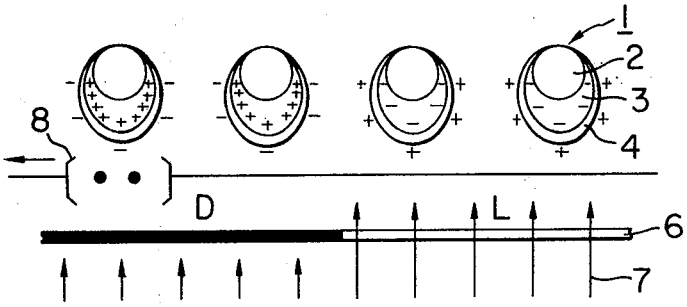

FIG. 3 indicates the result of the secondary voltage application with the image irradiation processes being carried out simultaneously. For the secondary voltage application, use is made of the corona discharge with a voltage composed of a bias voltage of positive polarity superposed on an AC voltage as the power source. By these two processes simultaneously carried out, the surface potential of the insulative member 4 turns to the positive, although there still exists the negative potential on the surface part of the insulative member corresponding to the dark portion of the original image in contrast to the bright portion at the irradiated part thereof. This is due to existence of the positive electric charge in the vicinity of the insulative member 4 in the photoconductive member 3. The voltage for use in the secondary voltage application, besides the abovementioned AC voltage, may also be a DC voltage having an opposite polarity to that used in the primary voltage application. Further, in case the dark attenuation characteristic of the photoconductive member is slow, the voltage application and the image irradiation processes can be carried out sequentially, not simultaneously as mentioned above. In this drawing figure, the reference numeral 6 designates an original image, wherein L is the bright portion and D is the dark portion of the image pattern; 7 designates light beam; and 8 represents the corona discharger. By the secondary voltage application and the image irradiation processes, an electrostatic latent image is formed on the screen 1, and the thus formed latent image increases its electrostatic contrast with lapse of time, or by the overall surface irradiation, whereby the primary electrostatic latent image is completed.

Figure 4:
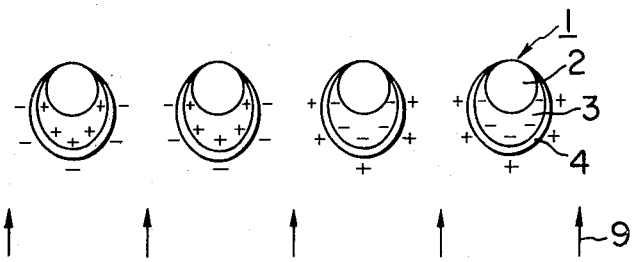

FIG. 4 represents the results of the overall surface irradiation having been done on the abovementioned screen 1. While no change takes place in the surface potential of the screen 1 at its bright portion by this overall surface irradiation process, the surface potential at the dark portion thereof rapidly changes to an electric potential which is proportionate to the amount of the surface charge on the insulative member 4, whereby the primary electrostatic latent image is formed. The reference numeral 9 in this drawing figure denotes the light beam.

Figure 5:
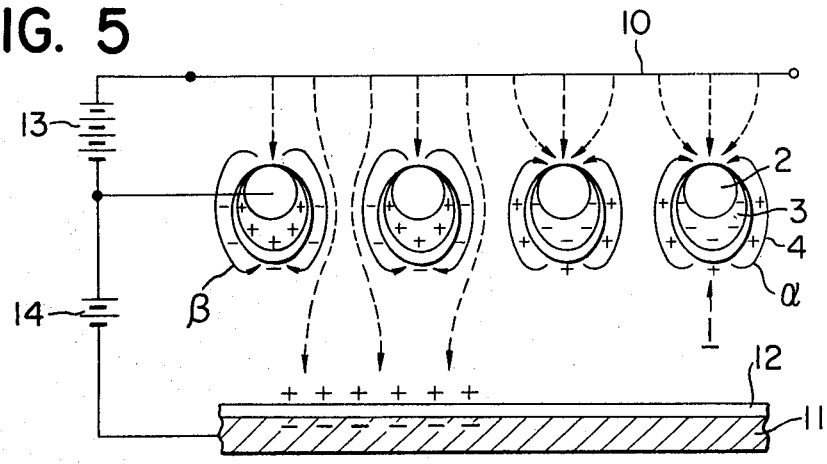
FIG. 5 is a schematic diagram showing one embodiment of the secondary electrostatic latent image forming process from the abovementioned primary electrostatic latent image.

FIG. 5 shows a state, wherein ion current is modulated by the primary electrostatic latent image on the screen 1 so as to form on a recording member a positive image of the original by the modulated electric charge. In this drawing figure, the reference numeral 10 designates a corona wire of the discharger, 11 an electrode member, 12 an image carrier which is capable of maintaining the electric charge (hereinafter referred to as "reproduction paper"), and 13, and 14 a power source.

As seen from the drawing, the reproduction paper 12 is disposed in the neighbourhood of the insulative member 14 of the screen 1, and the corona wire 10 is disposed at the side where the conductive member 2 of the screen 1 is exposed to the outside, whereby the corona ion current from the corona wire 10 is impressed on this reproduction paper 12 by making use of the potential difference between the corona wire 10 and the electrode member 11. At this time, there is created an electric field as shown by the solid line $\alpha$ at the bright portion of the screen 1 by the electric charge to form the primary electrostatic latent image. By the thus formed electric field, the ion current shown by the dotted line is prevented from passage through the screen, and is caused to flow into the conductive member 2 from the exposed portion thereof. In contrast to this, there is created an electric field shown by the solid line $\beta$ at the dark portion of the screen 1, and the ion current, in spite of its being of an opposite polarity to that of the primary electrostatic latent image, reaches the reproduction paper 12 without obliterating the formed electrostatic latent image. Moreover, as the primary electrostatic latent image is formed on the insulative member 4 as mentioned above, it is possible to raise the electrostatic contrast due to the amount of electric charge to a very high level. It is also possible that attenuation of the formed electric charge can be reduced as small as possible, hence formation of the secondary electrostatic latent image for repeated number of times can be done by a single primary electrostatic latent image, whereby the so-called retention copying, wherein multiple reproduction copies of the original image can be made from one and same primary electrostatic latent image, becomes possible.

In the above-examplified screen, it is only at the time of the primary electrostatic latent image formation that the corona ion is impressed on the surface of the insulative member. Since, at the time of the secondary electrostatic latent image formation, most of the corona ion, except for that reaching the reproduction paper 12 through the screen 1, flows into the conductive member of the screen, so that there is no possibility of the corona ion being impressed on the surface of the insulative member. In this consequence, adherence of dust detrimental to the screen 1 mostly takes place at the time of the primary electrostatic latent image formation, and the amount of the dust adhered is proportionate to the number of times a primary electrostatic latent image is formed, for the abovementioned reason. On account of this, when a screen capable of carrying out the retention copying as mentioned above, is used, the number of times of the secondary electrostatic latent image formation becomes much higher than that of the primary electrostatic latent image formation. Therefore, in the electrophotographic device using such photoconductive screen, the cleaning operation of the screen in correspondence to the number of times of the primary electrostatic latent image formation is effective in preventing the screen from becoming worn out due to the cleaning device.

With the abovementioned fact in mind, one actual embodiment of the reproduction device having the aforedescribed photosensitive screen and the cleaning device will be explained in reference to FIG. 6.

Figure 6:
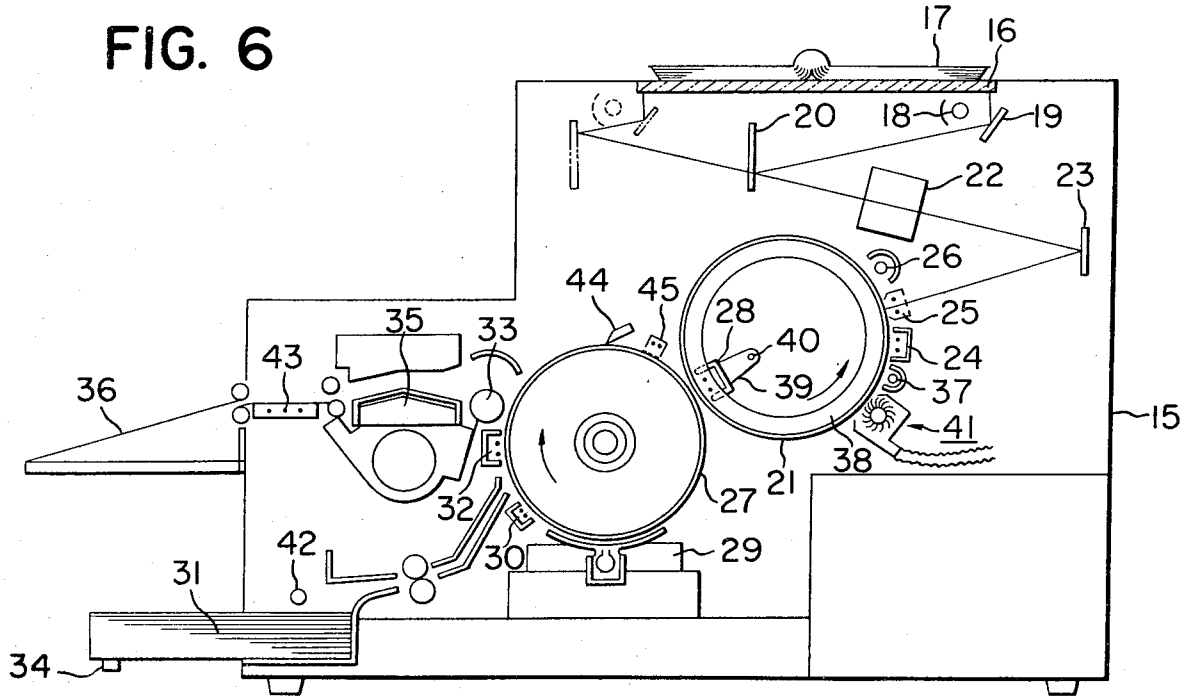
FIG. 6 is a schematic cross-sectional view for explanation of a construction of a reproduction apparatus which is one actual embodiment of an image forming device using the photosensitive screen, to which the present invention is applied.

In FIG. 6, the reference numeral 15 designates a housing, in which various mechanical components are accommodated, and 16 is a stand for holding a glass plate, on which an original image 17 is placed. Below the stand 16 for placing the original image thereon, there are provided a lamp 18 for illuminating the original image and a first reflector mirror 19, both of which can shift together along the lower surface of the stand 16 upto a position as indicated by double-dotted line, and a second reflector mirror 20. The original image illuminated by the lamp 18 reaches, through an optical system, the photosensitive screen 21 which has been mentioned in the foregoing in reference to FIG. 1 and which is constructed in a cylindrical shape with the exposed part of the conductive member constituting the inner surface thereof. The abovementioned optical system includes the abovementioned movable first reflector mirror 19, the second reflector mirror 20, a lens section 22 having a fixed aperture mechanism, and a third reflector mirror 23. Around the outer peripheral part of the abovementioned cylindrical screen 21, there are provided a series of means for the image formation and cleaning of the screen such as a cleaning device 41 having a rotary brush, which is one of the examples for the cleaning means, and a suction mechanism for drawing dust removed from the screen, a corona discharger 24 for the primary voltage application, another corona discharger 25 for the secondary voltage application, a part of which is open to receive light reflected from the reflector mirror 23 disposed adjacent to the corona discharger 24, and a lamp 26 for the overall surface irradiation disposed adjacent to the corona discharger 25. All these means are fixedly disposed around the screen 21 with an appropriate gap being provided with respect to the outer peripheral surface of the cylindrical screen.

Adjacent to the cylindrical screen 21, there is further provided a drum-shaped member 27 in a freely rotatable manner and with a small gap between the cylindrical screen, on the surface of which there is provided an insulative layer where the secondary electrostatic latent image is to be formed. Facing this drum-shaped member 27, still another corona discharger 28 for the secondary electrostatic latent image formation is fixedly provided inside the abovementioned cylindrical screen 21. Beneath the abovementioned drum-shaped member 27, there is provided a liquid developer 29, and, around this drum-shaped member 27, there are further arranged a corona discharger 30 to carry out liquid-squeezing for increase in the image transfer efficiency of the developed image, another corona discharger 32 to transfer the developed image on the reproduction paper 31 such as ordinary white paper, etc., and a separating means 33 for separating the reproduction paper, on which the developed image has been transferred. The reference numeral 34 at the bottom left part of the apparatus designates a cassette which constitutes the storage for the reproduction paper 31, the numeral 35 denotes thermal drying and fixing means, and 36 a delivery tray.

Now, in the following, a process for obtaining a reproduction copy of the original by use of the reproduction apparatus of the abovementioned construction will be explained in full detail.

In the drawing, the screen 21 is constructed as shown in FIG. 1 with a metal net of 200 mesh made of stainless steel wire of 40 microns in diameter, on which a dispersion layer of CdS in a resin and a surface insulative layer of epoxy resin are coated. On the other hand, before the original picture image 17 on the stand 16 is focussed on the screen 21 which is being rotated at a peripheral speed of 150 mm/sec. by the lamp 18 through the optical system, the screen 21 is caused to rotate in the direction of the arrow mark so as to be cleaned by the cleaning device 41 utilizing a rotary brush which is operated by a mechanism to be explained hereinafter. The brushing part of the rotary brush is only erected by the centrifugal force at the time of its rotation to contact the screen surface, and the dust removed by this brushing action is collected into a dust collecting part (not shown) by a suction mechanism to be described hereinbelow, or discharged outside the reproduction apparatus. The screen 21 which has completed the necessary cleaning is then subjected to the corona discharge in the positive polarity of 8 to 9 KV by the corona discharger 24 which is the means for forming the primary electrostatic latent image. After completion of this primary voltage application, the screen 21 is then irradiated thereon with the original picture image by way of the third reflector mirror 23 of the optical system at a brightness of approximately 6 lux per second. At the same time, a negative corona discharge of 7 KV is imparted to the screen by means of the corona discharger 25. Further, by the subsequent overall surface exposure of the screen by means of the lamp 26 at a brightness of 200 lux per second, there is finally formed on the screen 21 the primary electrostatic latent image having a bright portion of −50 V and a dark portion of +300 V. The cleaning device 41 in the afore-described embodiment of the reproduction apparatus according to the present invention is further provided with a mechanism for its stoppage which commences operation as soon as the image irradiation in the primary electrostatic latent image forming process as will be described hereinbelow is completed. On the other hand, the screen 21, on which the primary electrostatic latent image has been formed, acts to modulate by means of the primary electrostatic latent image a corona current of −8 KV from the corona discharger 28 for the secondary electrostatic latent image formation, whereby the secondary electrostatic latent image having a bright portion of 0 V and a dark portion of −500 V is formed on the drum-shaped member having the insulative layer thereon. Incidentally, at the time of forming the secondary electrostatic latent image, the drum-shaped member is reached, a 3 mm-gap is provided between the screen 21 and the drum-shaped member 27, and a voltage of −4 KV is applied to the electrically conductive part of the screen. The drum-shaped member 27 is then developed in the developer 29 with developing liquid, in which toner particles are dispersed, after which the developed picture image on this drum-shaped member 27 is transferred to the reproduction paper 31, and fixed thereon, and the thus produced reproduction copy is sent out into the delivery tray 36. When a plural number of sheets of the reproduction copy from the original image are desired, the exposure of the original image, the primary and secondary voltage applications, and the overall surface irradiation for the primary electrostatic latent image formation are not carried out, but the abovementioned screen 21 and the drum-shaped member 27 are caused to rotate synchronously, while conducting the corona discharge by means of the corona discharger 28 for the secondary electrostatic latent image formation, to form the secondary electrostatic latent image as in the abovementioned manner, whereby multiple secondary electrostatic latent images can be formed from one and same primary electrostatic latent image. The rotational speed of the screen at the time of the primary electrostatic latent image formation may be slow, and such slow speed may even be convenient for the optical system, a part of which is subjected to shifting. On the other hand, however, as the rotational speed of the screen and the drum-shaped member 27 at the time of the secondary electrostatic latent image formation is considerably high, the speed in each stage of development, paper feeding, and fixing is increased accordingly, hence retention copying becomes possible within the extent of such increased speed.

In the drawing, the exposure lamp 37 is to form a stable latent image having a constant photo-hysteresis at the time of the primary electrostatic latent image formation. Also, the reference numeral 38 designates a drum-shaped frame to support the screen 21, 39 denotes a rotational body supporting the corona discharger 28, 40 is a rotational axis therefor, 42 is a feed-out roller for the reproduction material, 43 indicates the corona discharger for removing electric charge from the reproduction material, 44 denotes cleaning means for the drum-shaped member 27, and 45 is a corona discharger for causing the drum-shaped member 27 to have uniform electric potential thereon.

Figure 7:
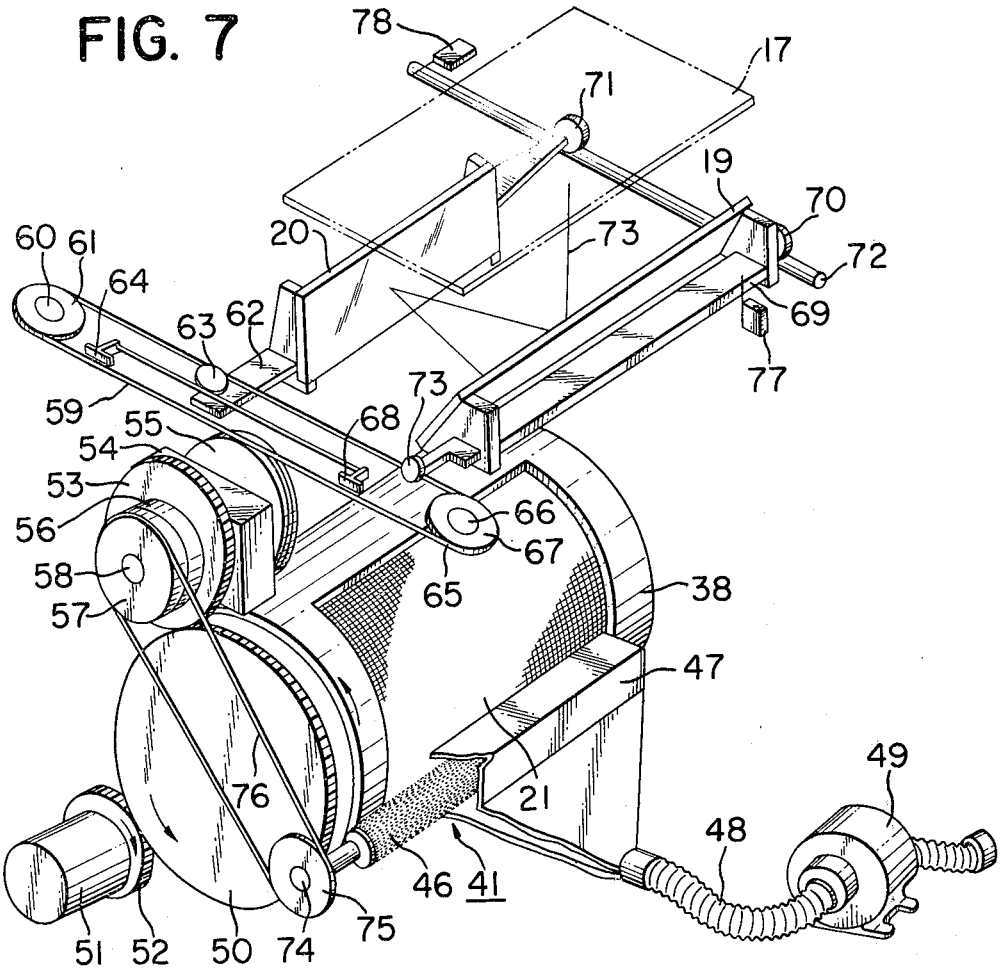
FIG. 7 is a perspective view of a cleaning device and the control mechanism therefor of the reproduction apparatus shown in FIG. 6 above.

In the following, the operation and control of the cleaning device in this embodimental reproduction apparatus according to the present invention will be explained in detail in reference to FIG. 7.

In the drawing, the cleaning device 41 comprises a brush 46, a duct 47, a flexible tube 48, and a suction means 49. Air sucked by this suction means is discharged outside the device. The frame 38 to support the screen 21 rotates in the direction of the arrow mark along with rotation of a drum gear 50 provided at one end part of the frame 38 which is meshed with a motor gear 52 fixedly provided at one end part of a motor 51. Also, the first mirror 19 and the second mirror 20 perform required motions with rotation of the wire drum 55 rotating with the rotation of the gear 53 which is meshed with the abovementioned drum gear 50 through a rotation converter 54. The abovementioned gear 53 causes a pulley 57 to rotate through an electromagnetic clutch 56, and the cleaning device is operated by the rotation of the pulley 57. Explaining this operation in more detail, for the screen 21 to be rotated in the arrow direction at the time of forming the primary electrostatic latent image on this screen, the motor gear 52 is fixedly provided at one part of the electric motor 51 so as to be meshed with the drum gear 50. When the motor 51 is driven, the drum gear 50 and the motor gear 52 mesh each other to cause the screen to rotate. Further, the drum gear 50 and the gear 53 mesh each other and are subjected to rotation by the rotation of the electric motor 51. The gear 53 is fixedly provided on the shaft 58. The shaft 58 extends to the wire drum 55 through the rotation converter 54, and causes the wire drum 55 to rotate both forwardly and reversely. One end of a wire drum 59 is fixed on one part of the wire drum 55, and the other end thereof is fixed on a stopper metal 64 by way of a pulley 61 which is made freely rotatable with respect to a shaft 60 and another pulley 63 provided on a second mirror shifting stand 62. The stopper metal 59 is fixed to a main body of the apparatus (not shown), and so forth. Also, one end of the wire 65 is fixed on the wire drum 55, and the other end thereof is fixed on a stopper metal 68 through a pulley 67 provided in a freely rotatable manner with respect to the shaft 66, a pin 73 to cause the first mirror shifting stand 69 to be engaged with the wire 65, and a pulley 63. The stopper metal 68 is fixed to a main body (not shown), and so forth. Onto the first mirror shifting stand 69 and the second mirror shifting stand 62, there are fixedly provided the first mirror 19 and the second mirror 20, respectively. At the other end of each of the mirrors, rollers 70 and 71 slidably move along the rail 72. The image irradiation is carried out in such a way that the original picture image 17 placed on the stand 16 is irradiated on the screen 21 stretched between both ends of the frame 38 by an illuminating lamp (not shown) through the first and second mirrors as shown in the solid line 73. In order to carry out the optical scanning over the entire width of the original image 17 on the stand 16, both first and second mirrors 19 and 20 are caused to reciprocally move. The abovementioned mirrors are moved by controlling the rotation of the abovementioned shaft 58 by way of the rotation converter 54. On this rotational shaft 58, there is provided a pulley 57, besides the gear 53, while, on the rotational shaft 74 of the brush 46, there is provided a pulley 75. Between these pulleys 74 and 75, there is stretched a belt 76, and, by the rotation of the pulley 57, the brush 46 synchronously rotates there with to carry out the cleaning of the screen 21. Incidentally, the abovementioned electromagnetic clutch 56 is operated in accordance with the shifting of the first mirror shifting stand 69. That is to say, a pair of detection switches 77 and 78 such as micro-switches, etc. are disposed at positions relative to the moving range of the abovementioned mirror stand 69, and, when this mirror stand 69 begins to shift, the switch 77 detects this movement and causes the abovementioned clutch 56 to operate. At this time, the cleaning device, due to the abovementioned construction thereof, causes the brush to rotate, simultaneously actuating the suction means. When the abovementioned mirror stand 69 has moved the whole shifting range, the switch 78 detects completion of the shifting, and the cleaning device ceases its operation. In the aforedescribed embodiment of the cleaning device according to the present invention, the front end part of the screen 21 is in the neighbourhood of the cleaning device, while in stoppage. Then, when the first mirror commences movement, and performs the image irradiation on the screen 21, the first and second mirrors take their positions as shown in FIG. 6.

In the reproduction apparatus where retention copying is possible as mentioned above, the effective method for operating and controlling of the cleaning device is such that, besides the abovementioned method, it is operated in accordance with operational frequency of the primary electrostatic latent image forming means. On the other hand, however, in the reproduction apparatus where retention copying is impossible, the operation of the cleaning device can be controlled by utilizing the combination of the optical system and other operating members such as developing means, etc., for the frequency of use of the screen and time lapse, etc. can be made known by combination of such optical system and other operating members which operate during the reproduction process.

By thus arranging the cleaning device, the primary electrostatic latent image forming means, and the secondary electrostatic latent image forming means along the moving direction of the screen 21, as described in the foregoing, various defects inherent in the prior art devices can be removed. In other words, since the screen is subjected to cleaning operation immediately before formation of the primary electrostatic latent image, the insulative part on the surface of the screen can be always maintained free from dust, whereby voltage application is conducted under a highly insulative condition of the screen, which enables the primary electrostatic latent image of good quality to be formed. Moreover, in comparison with the case of cleaning the screen after completion of the reproduction process, there is no apprehension of dust accumulation during idle periods of the apparatus, hence the above-described construction of the cleaning device according to the present invention is highly effective in eliminating any defects of the known apparatus.

Figure 8:
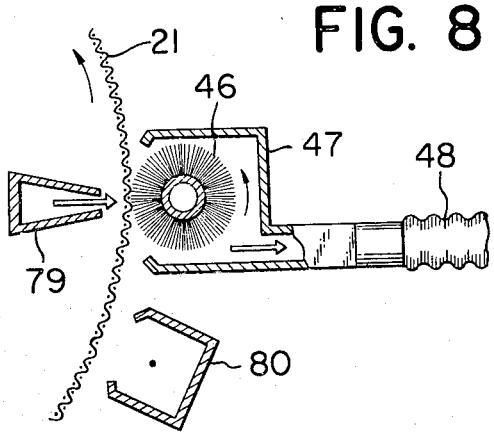
FIGS. 8 and 9 are respectively the main part of other embodiments of the dry-type cleaning device for use in the photoconductive screen.
Figure 9:
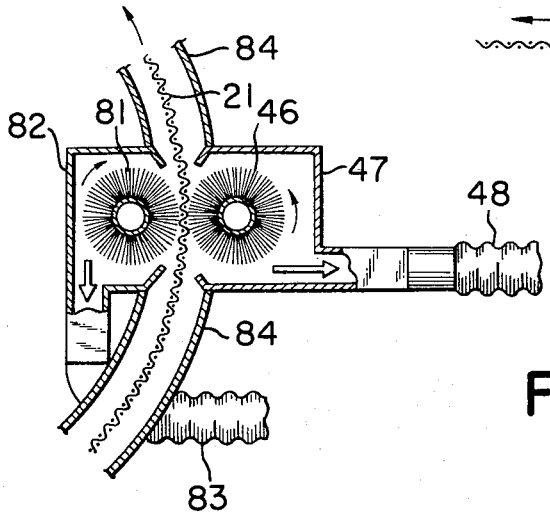

FIGS. 8 and 9 show other embodiments of the cleaning device according to the present invention, wherein the cleaning efficiency in the abovementioned screen can be further increased. Incidentally, the drawing figures are the partly enlarged crosssection of the cleaning part of the reproduction apparatus shown in FIG. 7.

FIG. 8 shows a construction, wherein a nozzle 79 for ejecting compressed air is disposed opposite to a brush 46 with the screen 21 being interposed therebetween. The gas such as air, etc. to be ejected from the nozzle 79 should preferably be one that has been pre-treated for dust removal therefrom. By the action of this nozzle, it is possible to remove dust adhered even to the openings of the screen 21, hence extremely favorable cleaning results can be obtained. Much better result will further be obtained in this cleaning operation by removing the electric charge accumulated on the dust adhered onto the screen in advance of its being subjected to the cleaning operation by means of the AC corona discharge from the corona discharger 80, whereby the dust can be easily removed from the screen.

In the following, mention will be made as to the arrangements of the cleaning device and the auxiliary means thereto. First of all, the cleaning means made of friction member such as brush, cloth-covered roller, etc. should preferably be arranged at the side where the insulative member of the screen is present. The reason for this is that, at the time of forming the latent image, the insulative member (including the photoconductive material) on the screen surface has, in most cases, been subjected to the corona discharge, and, when electrically conductive dust adheres onto this insulative member, no sufficient charging of the screen becomes possible as mentioned in the foregoing. The auxiliary means for the cleaning device should be disposed at positions where the highest cleaning effect can be obtained. When the screen is of the symmetrical shape between its front and rear surfaces, the cleaning device and the auxiliary means may be disposed at any suitable position on the front or rear surface of the screen. In this manner, by causing high pressure gas to pass from one surface side of the screen through the openings thereof, cleaning efficiency of the screen is increased.

FIG. 9 shows another embodiment of the cleaning device according to the present invention, wherein the cleaning member is provided at both surfaces of the screen. In the drawing, the reference numeral 81 designates brush, 82 a duct, and 83 a flexible tubing. The flexible tubing 83 is so constructed that it leads to the abovementioned suction device 49. Further, the reference numeral 84 designates a dust protecting wall which is so disposed that it shields the screen from the external air along the moving path thereof. The protective wall 84 covers substantially the entire screen, except for the portion where the latent image forming means are provided with respect to the screen, whereby adherence of dusts can be prevented even at the time of non-use of the apparatus, and much better cleaning effect of the screen can be obtained. The arrangement of the cleaning device at both sides of the screen as shown in FIG. 9 is the most suitable construction when the screen is constructed symmetrically at both front and rear surfaces. Further, it is preferable from the standpoint of dust prevention and high cleaning efficiency that the interior of the abovementioned dust prevention wall 84 be filled with gas such as air, from which undesirable dust has been removed in advance. Incidentally, a thick arrow mark in the cleaning device shown in FIG. 9 indicates a flowing direction of the gas within the cleaning device, whereby the gas containing therein removed dust from the screen is immediately drawn by the suction device, etc. to be introduced into another place such as dust collector outside the cleaning device, whereby the cleaning device can always be kept clean. It goes without saying that the corona discharger of FIG. 8 can be applied to the device shown in FIG. 9, and inversely, the dust prevention wall 84 in FIG. 9 can of course be applied to the screen shown in FIG. 8.

Next, in reference to FIGS. 10 to 13, other embodiments of the present invention will be explained.

Figure 10:
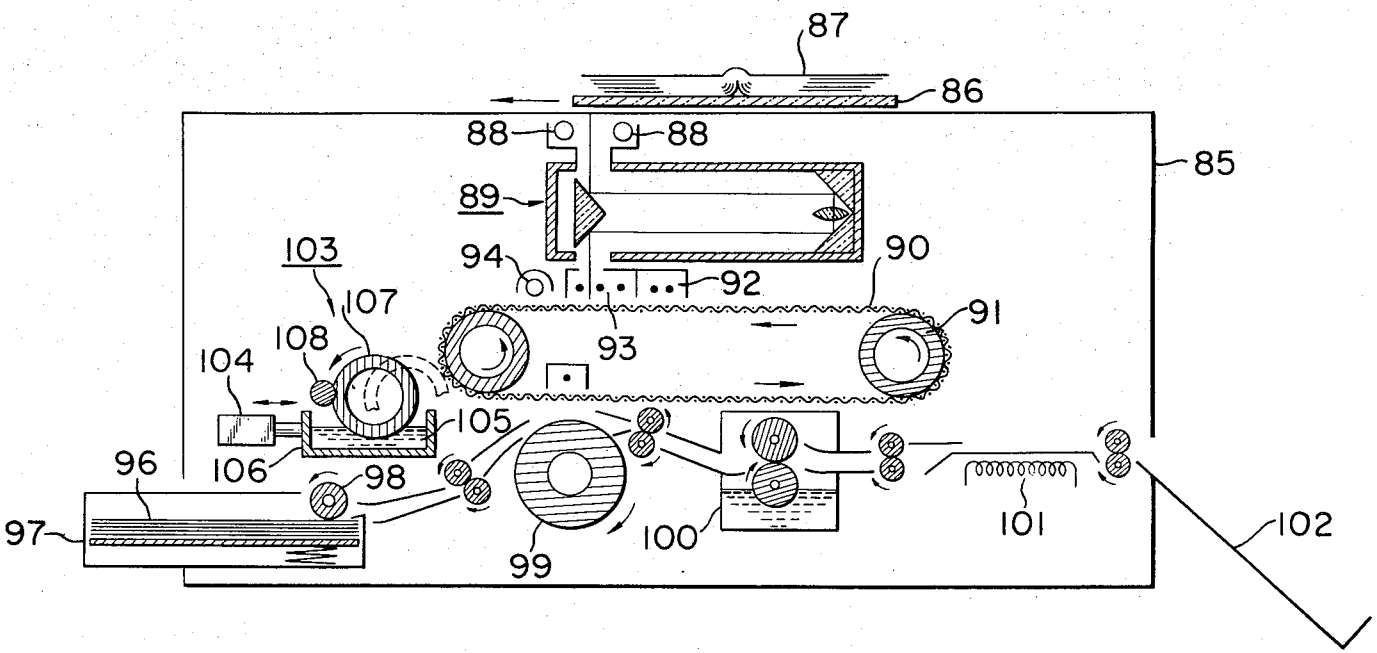
FIG. 10 is a schematic cross-sectional view showing a construction of the reproduction apparatus which is the image forming device provided with a wet-type cleaning device according to the present invention.

FIG. 10 illustrates a reproduction apparatus, in which the screen of FIG. 1 is used. In the apparatus shown, the reference numeral 85 is a housing to accumulate therein various mechanical components of the reproduction apparatus, and 86 denotes a stand for the original image, in which a glass plate is set at a predetermined position to place thereon the original image 87. Below the abovementioned stand 85 for the original image 87, there are disposed a lamp 88 for illuminating the original image, and a fixed optical system 89 comprising reflection mirrors, lenses, and so on. The original image irradiated by the lamp 88 forms an image of the original on the screen 90 through the abovementioned optical system. On the other hand, the screen 90 is constructed in a belt form with the side where the electrically conductive member is exposed outside being made to constitute the inner side. The screen 90 is spanned around a pair of drive rollers 91, and rotates in the direction of an arrow mark in synchronism with movement of the abovementioned stand for the original image. Thus, the screen 90 receives the primary voltage application from the corona discharger 92, and further receives exposure light of the original image as mentioned above, while receiving the secondary voltage application from the discharger 93. Subsequently, the overall surface of the screen formed thereon with the latent image is then subjected to the overall surface irradiation by means of the lamp 94, thereby forming the primary electrostatic latent image on the screen 90. The reference numeral 95 represents a corona discharger for forming the secondary electrostatic latent image, and, when the primary electrostatic latent image on the screen reaches this position, a reproduction paper 96 is conveyed to the position in synchronism with this primary electrostatic latent image. The reproduction paper 96 consists of insulative paper such as electrostatic recording paper, etc. which is usually placed in a paper-feeding cassette 97, each sheet being fed into the reproduction apparatus by means of a feeding roller 98. The reference numeral 99 designates an opposite electrode for the corona discharger 95, 100 a container for liquid developer, 101 an image fixing means, and 102 a delivery tray. Moreover, the reference numeral 103 in the vicinity of the screen 90 denotes the cleaning device for the screen.

When the abovementioned screen 90 requires the cleaning operation by the cleaning device 103 due to its being stained, an electromagnetic plunger 104 is first actuated by the operation of an external switch (not shown) to shift the entire device 103 to the right. The cleaning device 103 is provided with a container 106 to accommodate therein organic substance 105 such as alcohol, methylethyl ketone, and so on, and a cloth-covered roller 107 which is wetted with the organic substance 105, and a squeeze roller 108. Both rollers 107 and 108 contact the rotating screen 90, while they are being rotated by drive means such as an electric motor, etc., to thereby clean the screen 90. When the cleaning operation is over, the cleaning device 103 is returned to its original position by the action of the above-mentioned plunger 104. For the abovementioned organic substance 105, ethanol, methylethyl ketone, xylol, benzene, and so forth can be used. The organic substance should be replaced from time to time due to its contamination as a result of the cleaning operation. This use of the organic substance as mentioned above provides an effect of removing electric charge from the screen with the result that separation of dust from the screen is facilitated. Moreover, due to the quick drying property of the organic substance, the cleaning of the screen can be done very efficiently. The cloth-covered roller 107 is not necessarily wetted with the organic substance. In such case, however, the cloth might have to be replaced at an appropriate time interval, for the cloth is liable to be stained with the dust. On the other hand, the cloth-covered roller 107 may of course be substituted by another type of roller such as, for example, one that is made of a soft raw material such as a sponge roller impregnated with such organic liquid.

Besides using an appropriate external switching means as mentioned above, the operation of the cleaning device 103 can also be performed conveniently and automatically by means of an integrated amount metered by a counter (particularly, counting the number of times of the primary electrostatic latent image formation is effected) in accordance with the number of times, in which the screen is used. When the roller is made of the electrically conductive member having the above-mentioned electric charge removing effect, the cleaning device 103 may be operated either upon completion of retention copying, or prior to formation of a new image. In this case, it is preferable, from the standpoint of increasing the reproduction speed, that the counting mechanism be provided with a discriminating means to prevent the cleaning device from operating during retention copying.

Hereinbelow, explanations of other embodiment of the wet type cleaning device will be gives.

Figure 11:
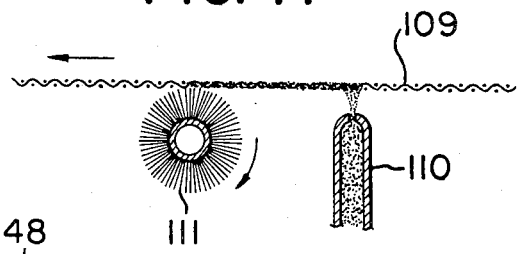
FIGS. 11 to 13 are respectively schematic cross-sectional views showing other embodiments of the wet-type cleaning device than that shown in FIG. 10 above.
Figure 12:
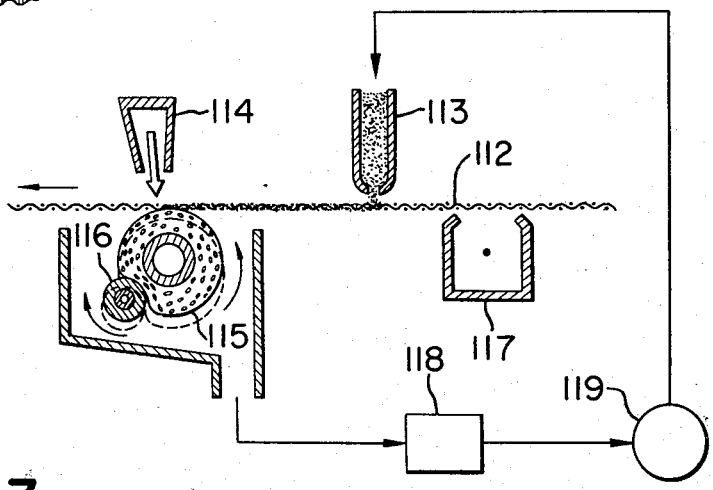

FIGS. 11 and 12 show schematic cross-sections of the arrangements and constructions of a planar screen and the cleaning device at their cleaning position. The reference numeral 109 in the drawing designates the screen, and 110 denotes a nozzle for ejecting rinsing liquid to the screen 109. The nozzle 110 is disposed in the direction perpendicular to the forwarding direction of the screen 109. 111 designates a brush which is constructed with moisture absorbing material such as a cloth, sponge, and so forth. The rinsing liquid used is a volatile solution such as those abovementioned organic substances which volatilize instantaneously and make it possible to complete the cleaning operation in a very short period of time.

In FIG. 12, the reference numeral 112 designates the screen, 113 the nozzle for ejecting the rinsing liquid so as to apply the liquid onto the screen, 114 denotes another nozzle for ejecting high pressure gas in the direction of the thick arrow mark to the screen 112. Opposite to the nozzle 114 arranged in parallel with the nozzle 113, there is provided a roller 115 made of a moisture absorbing material such as sponge and which rotates in the arrow direction. The roller 115 is provided adjacent thereto with a liquid squeezing roller 116. Further, the reference numeral 117 is a corona discharger for removing electric charge on the dust in advance before the screen 112 is subjected to the cleaning operation. High pressure gas ejected from the nozzle 114, as mentioned with reference to FIG. 8 above, should preferably be dust-free air, and so on which has been pre-treated through a dust removing means. Further, the ejecting direction of the compressed gas in the embodiments in the present invention, regardless of whether it is the wet type or dry type cleaning, should be determined at an appropriate position in consideration of shape and moving speed of the cleaning device.

Figure 13:
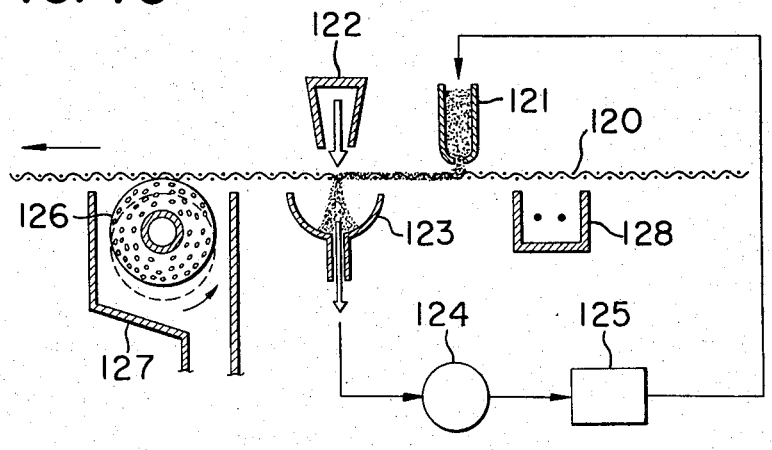

In the cleaning device using the rinsing liquid as in the embodiment shown in FIGS. 11 and 12, effective utilization of the rinsing liquid becomes possible by re-introducing the recovered liquid into the nozzle 113 through filtering means 118 and a pump 119, as shown in FIG. 12 and FIG. 13 which will be explained hereinbelow.

In the system, wherein the rinsing liquid at the openings of the screen is blown away by the high pressure gas, not only the dust at the openings of the screen is removed sufficiently, but also the thus removed dust does not scatter again, hence this is an effective cleaning method. In such device, the member having moisture absorbing property and being opposed to the nozzle 114 need not always be in the shape of the roller. Of course, as shown in FIGS. 11 and 12, it is preferable, from the standpoint of increasing the durability of the screen, that the cleaning device be positioned separate from the screen as indicated by the dotted line when it is not in operation, and be in contact with the screen only during the cleaning operation.

The cleaning device shown in FIG. 13 is a further improvement in the afore-described embodiment of the cleaning device, wherein the screen 120 moves in the arrow direction. In the drawing, the reference numeral 121 is a nozzle for applying rinsing liquid to the screen 120, and 122 designates a nozzle for ejecting compressed air. Opposite to the nozzle 122, there is disposed a suction means 123 through the screen 120, and the rinsing liquid, while cleaning the screen, is blown away to reach the suction means 123. The rinsing liquid is then introduced into a filtering means 125 by a pump 124, and then sent to the abovementioned nozzle 122. The reference numeral 126 is the same roller as that described in the above embodiment in FIG. 12, which operates to wipe off the rinsing liquid remaining on the screen 120 as well as the cleaning by friction. The roller 126 may also be a brush type as in the embodiment of FIG. 11. This brush 126 is subjected to a suction force as shown by a thick arrow mark through a duct 127. The reference numeral 128 is an electric charge remover by the corona discharge.

In the above-described cleaning device, as the cleaning operation is carried out by passage of a substance through the openings of the screen and by friction of the screen surface, sufficient dust removing effect can be attained. In case volatile rinsing liquid is used, the brush 126 is not always required. Also, use of the nozzle 122 and the suction means 123 alone may suffice the cleaning purpose without use of the rinsing liquid, although it is preferred that the abovementioned auxiliary means be combined therewith. In each of the above-described embodiments, the nozzle for applying the rinsing liquid to the screen possesses a valve means which is operated in synchronism with the cleaning operation of the screen.

As stated in the foregoing, the cleaning of the photoconductive screen in the electrophotographic reproduction apparatus is required to above new mechanisms different from the conventional cleaning device. That is to say, since the screen has a multitude of tiny openings, no sufficient cleaning can be expected with the conventional friction means such as fur brush and blade, etc. In the afore-described embodiments, removal of electric charge on the dust adhered onto the screen is carried out with the AC corona discharge by means of the corona discharger for such removal purpose, although the discharger is not necessarily required. Furthermore, use of a nozzle for blowing compressed air to the screen is highly effective. Needless to say, it is possible to carry out cleaning of the openings of the screen by blowing very fine particles of a size which does not clog the screen openings, or rinsing liquid together with the abovementioned compressed air.

While it is preferable that the abovementioned brush member and the moisture absorbing member be disposed at a side of the screen where the cleaning is desired, the rotational direction and the speed thereof may be appropriately selected by the moving speed and shape of the screen. The screen and the cleaning means may, of course, be in a relationship of relative movement with respect to each other. The dust preventing wall disclosed in the embodiment shown in FIG. 9 is also applicable to the cleaning operation of both wet and dry type devices, by the use of which adherence of the dusts can be prevented, while the reproduction apparatus is stopped. The position of the cleaning device in the image forming apparatus using the photosensitive screen should preferably be at such a position where the screen passes by prior to formation of the primary electrostatic latent image, as mentioned with reference to the embodiment of FIG. 7. Further, the shape of the screen applicable to the afore-described cleaning device may not be restricted to those shown in the drawing, but any other appropriate shapes such as planar, web, drum, etc. may be chosen, depending on necessity.

Removal of dust adhered to the screen, which is the primary purpose of the present invention, becomes first feasible by the afore-described cleaning method and the device embodying the present invention. In other words, various problems existing as stated at the outset can be successfully solved by the application of the present invention, as the result of which image of good quality can be obtained.

Although the present invention has been described with reference to particularly preferred embodiments thereof, it is not restricted to these embodiments alone, but any changes and modifications may be made within the spirit and scope of the present invention as set forth in the appended claims.

We claim:

1. A method for protecting an endlessly movable photosensitive screen from an accumulation of dust, wherein the screen has a multitude of tiny openings for use in forming an image by modulating ion current and wherein the screen is disposed within a housing which also includes latent image forming means, and developing means for developing an image formed by modulating ion current, said method comprising:

substantially isolating the endlessly movable photosensitive screen from the ambient air in the housing with wall means disposed at least outside of the screen, but without interfering with its movement or with latent image formation, to substantially cover the entire screen.

2. The method as claimed in claim 1, wherein the wall means is disposed adjacent to the surface except where the latent image forming means are provided.

3. The method as claimed in claim 1, wherein a space within said wall means is filled with dust free air.

4. In a device including an endlessly movable photosensitive screen having a multitude of tiny openings for use in the formation of an image by modulating ion current, latent image forming means and developing means for developing an image formed by modulating ion current, the improvement comprising means for protecting the endlessly movable photosensitive screen from an accumulation of dust, said protecting means including wall means disposed at least outside the screen, but without interfering with its movement or with latent image formation, to substantially cover the entire screen.

* * * * *

UNITED STATES PATENT OFFICE

CERTIFICATE OF CORRECTION

Patent No. 4,298,268 Dated November 3, 1981

Inventor(s) TADASHI SATO, ET AL.

It is certified that error appears in the above-identified patent and that said Letters Patent are hereby corrected as shown below:

Column 3, line 51, after "means" delete "by";

line 55, after "means" delete "by".

Column 4, line 49, change "and" to --to--.

Signed and Sealed this

*Eighteenth* Day of *May 1982*

[SEAL]

*Attest:*

GERALD J. MOSSINGHOFF

*Attesting Officer*

*Commissioner of Patents and Trademarks*